US005944638A

United States Patent [19]

Maresh et al.

[11] Patent Number: 5,944,638

[45] Date of Patent: Aug. 31, 1999

[54] EXERCISE APPARATUS AND METHODS INVOLVING A FLYWHEEL

[76] Inventors: Joseph D. Maresh, P.O. Box 645, West Linn, Oreg. 97068-0645; Kenneth W. Stearns, P.O. Box 55912, Houston, Tex. 77055

[21] Appl. No.: 09/066,142

[22] Filed: Apr. 24, 1998

Related U.S. Application Data

[60] Provisional application No. 60/044,959, Apr. 26, 1997.

[51] Int. Cl.[6] ..... A63B 22/06

[52] U.S. Cl. ..... 482/63; 482/57; 482/110; 482/903

[58] Field of Search ..... 482/57, 63, 64, 482/65, 61, 903, 110; 601/34, 35, 36

[56] References Cited

U.S. PATENT DOCUMENTS

| | | | |
|---|---|---|---|
| 3,860,235 | 1/1975 | Del Mar | 272/73 |
| 3,960,144 | 6/1976 | Simjian | 128/58 |
| 4,152,617 | 5/1979 | Janson | 310/103 |
| 4,529,196 | 7/1985 | Logan et al. | 272/116 |
| 4,673,177 | 6/1987 | Szymski | 272/73 |
| 5,072,930 | 12/1991 | Sun | 272/73 |
| 5,094,447 | 3/1992 | Wang | 272/73 |
| 5,310,392 | 5/1994 | Lo | 482/63 |

FOREIGN PATENT DOCUMENTS

| | | | |
|---|---|---|---|
| 251919 | 1/1988 | European Pat. Off. | 482/903 |

*Primary Examiner*—Richard J. Apley
*Assistant Examiner*—Tam M. Nguyen

[57] ABSTRACT

An exercise apparatus has (a) a bi-modal seat that readily transforms between a first configuration, which is adapted for conventional cycling, and a second configuration, which is adapted for recumbent cycling; (b) a bi-modal flywheel assembly that readily switches between a direct drive configuration and a free-wheel configuration; and/or (c) a braking assembly which readily stops rotation of the flywheel at the discretion of a user.

16 Claims, 6 Drawing Sheets

EXERCISE APPARATUS AND METHODS INVOLVING A FLYWHEEL

CROSS-REFERENCE TO RELATED APPLICATION

This application discloses subject matter entitled to the earlier filing dates of Provisional Application No. 60/044,959, which was filed on Apr. 26, 1997.

FIELD OF THE INVENTION

The present invention relates to exercise methods and apparatus and specifically, to exercise equipment which links exercise movement to rotation of at least one flywheel.

BACKGROUND OF THE INVENTION

Exercise equipment has been designed to facilitate a variety of exercise motions and to link such motions to rotation of a crank and/or flywheel. Examples of such equipment include treadmills, which allow a person to walk or run in place; stepper machines, which allow a person to climb in place; bicycle machines, which allow a person to pedal in place; striding machines, which allow a person to move his feet back and forth in reciprocal fashion; and elliptical motion machines, which move a person's feet through a closed curve path of motion. Most such machines operate in one of two general ways, which are described below with reference to a cycling machine for ease of discussion.

Both basic types of cycling machines have a pedal assembly which is connected to a flywheel (by means of a belt, chain, or driveshaft, for example). As the user pedals, inertia is stored in the flywheel and subsequently provides sensations of smoothness and continuance to the exercise motion. In many cases, the flywheel is "stepped up" relative to the pedals to rotate faster and thereby provide greater inertia with less mass.

On a first, relatively traditional type of cycling machine, a one-way clutch is interconnected between the flywheel and the pedal assembly. The clutch causes the pedal assembly to drive the flywheel in a first direction but allows the pedals to rotate freely in a second, opposite direction. As a result, the user can stop pedaling or "coast" at any time, independent of the status of the flywheel.

On a second, relatively contemporary type of cycling machine, a direct drive relationship is established between the flywheel and the pedal assembly. The direct drive constrains the pedals and the flywheel to rotate together or not at all. As a result, any effort to stop the pedals will be resisted by whatever inertia is stored in the flywheel.

An advantage of the more contemporary cycling machine is that flywheel inertia essentially forces a user to continue cycling. A related disadvantage is that the flywheel inertia can present a safety hazard. An object of the present invention is to address this safety concern. Another object of the present invention is to provide a cycling machine which may be "switched" between a "direct drive" machine and a "free wheel" machine. Yet another object of the present invention is to provide accommodating or self-limiting inertia in conjunction with exercise movement.

SUMMARY OF THE INVENTION

The present invention provides various methods and apparatus which involves the connection of a flywheel to a pedal assembly. In one embodiment, a connector constrains "direct drive" rotation in a first state of operation, and allows "free wheel" rotation in a second state of operation. Additional features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

The present invention provides several improvements which may be described with reference to an exercise cycling machine. These improvements include:

(a) a bi-modal seat that readily transforms between a first configuration, which is adapted for conventional cycling, and a second configuration, which is adapted for recumbent cycling;

(b) a bi-modal flywheel assembly that readily switches between a direct drive configuration and a free-wheel configuration; and (c) a braking assembly which readily stops rotation of the flywheel at the discretion of a user.

The following description will describe each of these improvements individually and with reference to specific exercise cycling machines, but those skilled in the art will recognize that the improvements may be implemented on other, discrete types of exercise equipment, as well as in different combinations on all applicable types of equipment.

Bi-Modal Seats

Figure 2:
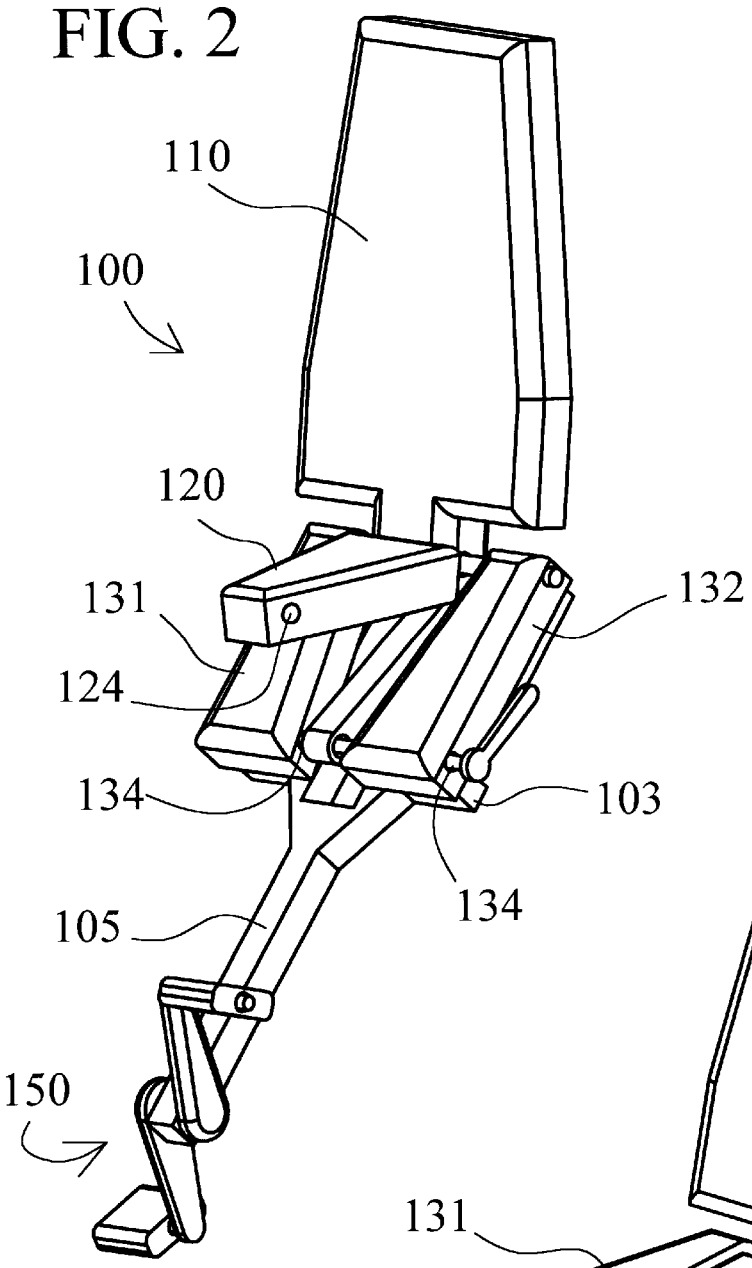
FIG. 2 is a perspective view of the exercise apparatus of FIG. 1 in a second configuration.
Figure 1:
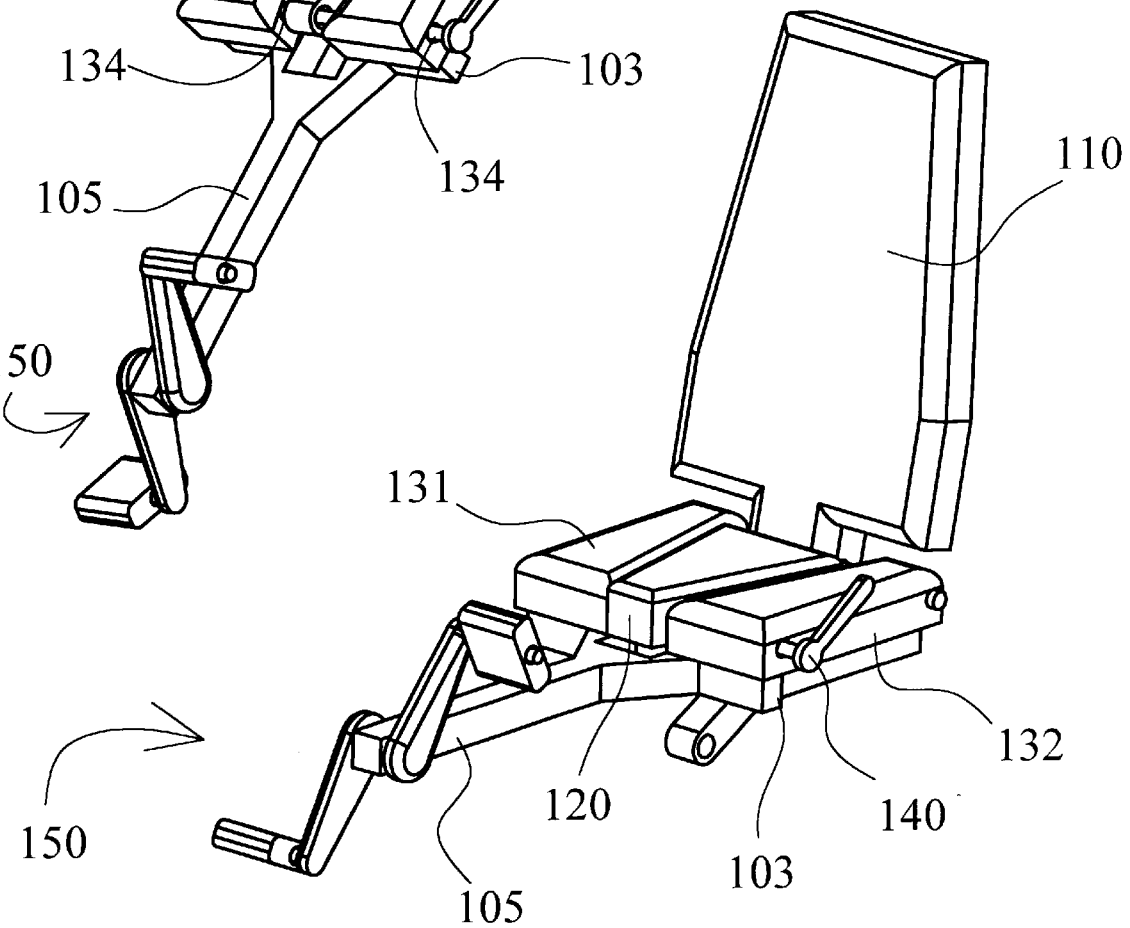
FIG. 1 is a perspective view of a first exercise apparatus constructed according to the principles of the present invention.

A first seat constructed according to the principles of the present invention is designated as 100 in FIGS. 1–2. The seat 100 includes a back portion 110, a central seat portion 120, and two outside seat portions 131 and 132. FIG. 1 shows the seat 100 in a first operative configuration which is comparable to a conventional chair configuration. In this first configuration, the three seat portions 120, 131, and 132 are substantially co-planar, and the back portion 110 defines an angle of approximately one hundred degrees relative thereto.

FIG. 2 shows the seat 100 in a second operative configuration which is more like a bicycle seat with a back rest. In this second configuration, the outside seat portions 131 and 132 are pivoted downward away from the central seat portion 120 and toward a parallel orientation relative to the back portion 110. As suggested by FIGS. 1–2, the central seat portion 120 may be described as having a forwardly tapered, isosceles planform, and the outside seat portions 131 and 132 may be described as having rearwardly tapered, trapezoidal planforms which are identical in size and configuration.

The outside seat portions 131 and 132 are pivotally connected to the back portion 110 and/or the central seat portion 120 to facilitate the transformation between the different configurations shown in FIGS. 1 and 2. Laterally extending holes 134 are provided in the outside seat portions 131 and 132 so that the seat 100 may be locked in either configuration. As shown in FIG. 1, a rod 140 extends through the holes 134 and a hole 124 in the central seat portion 120 to lock the seat 100 in the first configuration. The rod 140 similarly extends through the holes 134 and a hole in the frame to lock the seat 100 in the second configuration.

A frame member 103 is rigidly secured beneath the outside seat portions 131 and 132, and another frame member 105 is rigidly secured to the frame member 103. A pedal assembly 150 is rotatably mounted on the frame member 105 and rotates together with the outside seat portions 131 and 132 relative to the central seat portion 120 and the back portion 110. As a result, the pedal assembly 150 moves between a first position disposed generally forward of the seat 100 in FIG. 1, and a second position disposed generally beneath the seat 100 in FIG. 2.

Figure 3:
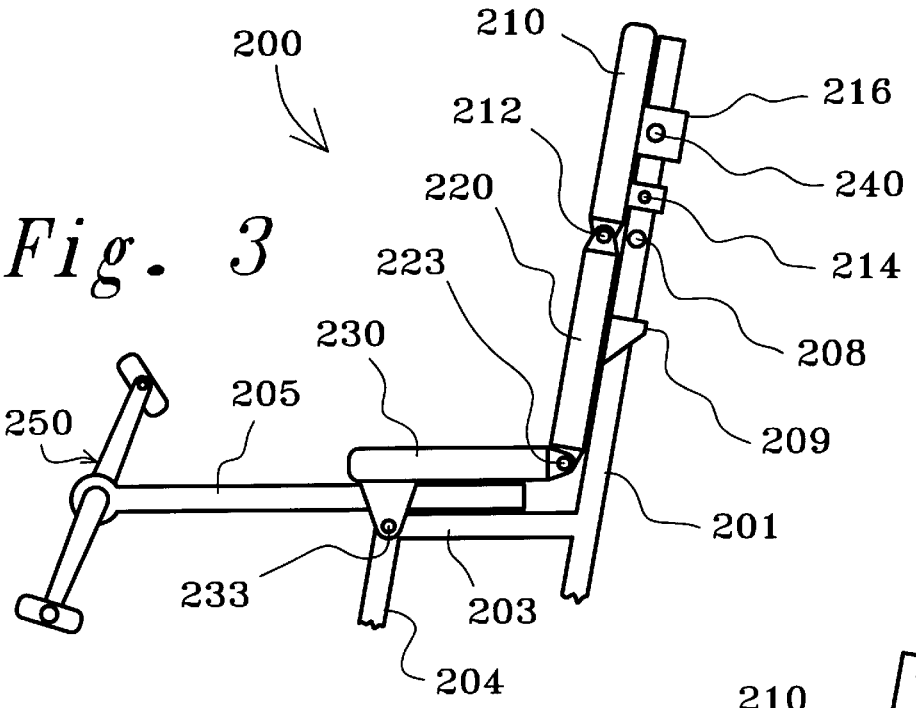
FIG. 3 is a perspective view of a second exercise apparatus constructed according to the principles of the present invention.
Figure 4:
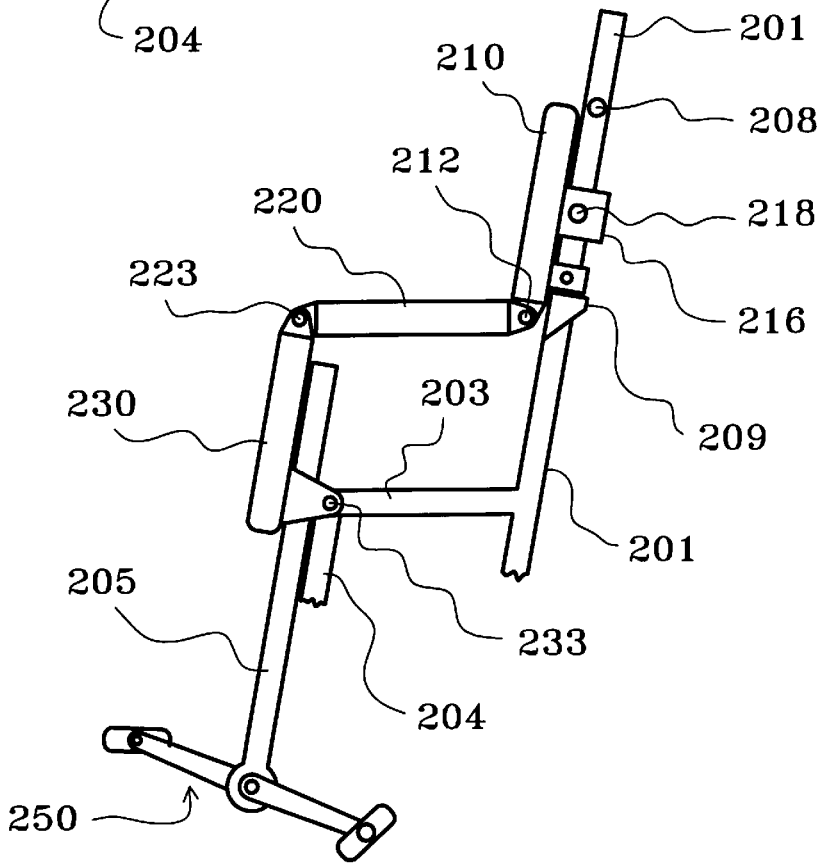
FIG. 4 is a perspective view of the exercise apparatus of FIG. 3 in a second configuration.

A second seat constructed according to the principles of the present invention is designated as 200 in FIGS. 3–4. The seat 200 includes an upper portion 210, an intermediate portion 220, and a lower portion 230. FIG. 3 shows the seat 200 in a first operative configuration which provides a relatively lower horizontal support surface. In this first configuration, the upper portion 210 and the intermediate portion 220 are substantially co-planar and define an angle of approximately one hundred and ten degrees relative to the substantially horizontal lower portion 230. FIG. 4 shows the seat 200 in a second operative configuration which provides a relatively higher support surface. In this second configuration, the upper portion 210 and the lower portion 230 extend substantially parallel to one another, and the intermediate portion 220 is substantially horizontal.

The seat portions 210 and 220 are pivotally connected to each other by a hinge 212, and the seat portions 220 and 230 are pivotally connected to each other by a hinge 223, to facilitate the transformation between the different configurations shown in FIGS. 3 and 4. A distal end of the lower seat portion 230 is rotatably mounted to a frame member 203. The upper seat portion 210 is rollably mounted to a frame member 201 by means of at least one roller assembly 214. A stop 209 on the frame member 201 limits downward movement of the upper seat portion 210 relative thereto. A bracket 216 is rigidly secured to the upper seat portion 210 and overlaps the frame portion 201. A hole in the bracket 216 aligns with one of two holes 208 in the frame member 201 to receive a fastener 240 which selectively locks the upper seat portion 210 in place relative to the frame portion 201.

A pedal assembly 250 is rotatably mounted on a frame member 205. The frame member 205 is rigidly connected to the lower seat portion 230 (e.g. by screws extending through the frame member 205 and into the seat portion 230) and thus, rotates together with the seat portion 230 relative to the frame member 203. Such an arrangement moves the pedal assembly 250 between a first position disposed generally forward of the seat 200 in FIG. 3, and a second position disposed generally beneath the seat 200 in FIG. 4. Frame members 201 and 204 extend downward to a floor engaging base. The frame member 204 also serves as a stop to limit downward pivoting of the pedal assembly 250.

Each of the embodiments 100 and 200 was shown with reference to a pedal assembly that pivoted together with one or more portions of the seat. However, the invention is not limited in this regard. In other words, the seats 100 and 200 are also useful on equipment which does not involve cycling and/or which provides a separate force receiving assembly for each seat configuration. For example, the seat 100 may be mounted on a machine which facilitates a rowing exercise when the seat is configured as shown in FIG. 1, and a cycling exercise when the seat is configured as shown in FIG. 2; or the seat 200 may be mounted on a machine having a pedal assembly which does not pivot but is adjustable horizontally relative to the frame, in which case the pedals are moved forward to facilitate recumbent cycling when the seat is configured as shown FIG. 3, and moved rearward to facilitate semi-recumbent cycling when the seat is configured as shown in FIG. 4.

Another variation of the present invention may be described with reference to the seat 100 shown in FIGS. 1–2. A central seat member similar in size and shape to the seat portion 120 is rigidly secured to a frame, and outside seat portions similar in size and shape to the seat portions 131–132 are similarly movably connected to the central seat member. A continuous flexible cover is then disposed over all three seat portions, and/or springs are disposed between the frame and the outside seat portions. In any event, the cover and/or the springs encourage the outside seat portions toward a co-planar relationship relative to the central seat portion, but also allow the outside seat portions to deflect somewhat during exercise (such as semi-recumbent cycling, for example).

Bi-Modal Flywheel Assemblies

Figure 5:
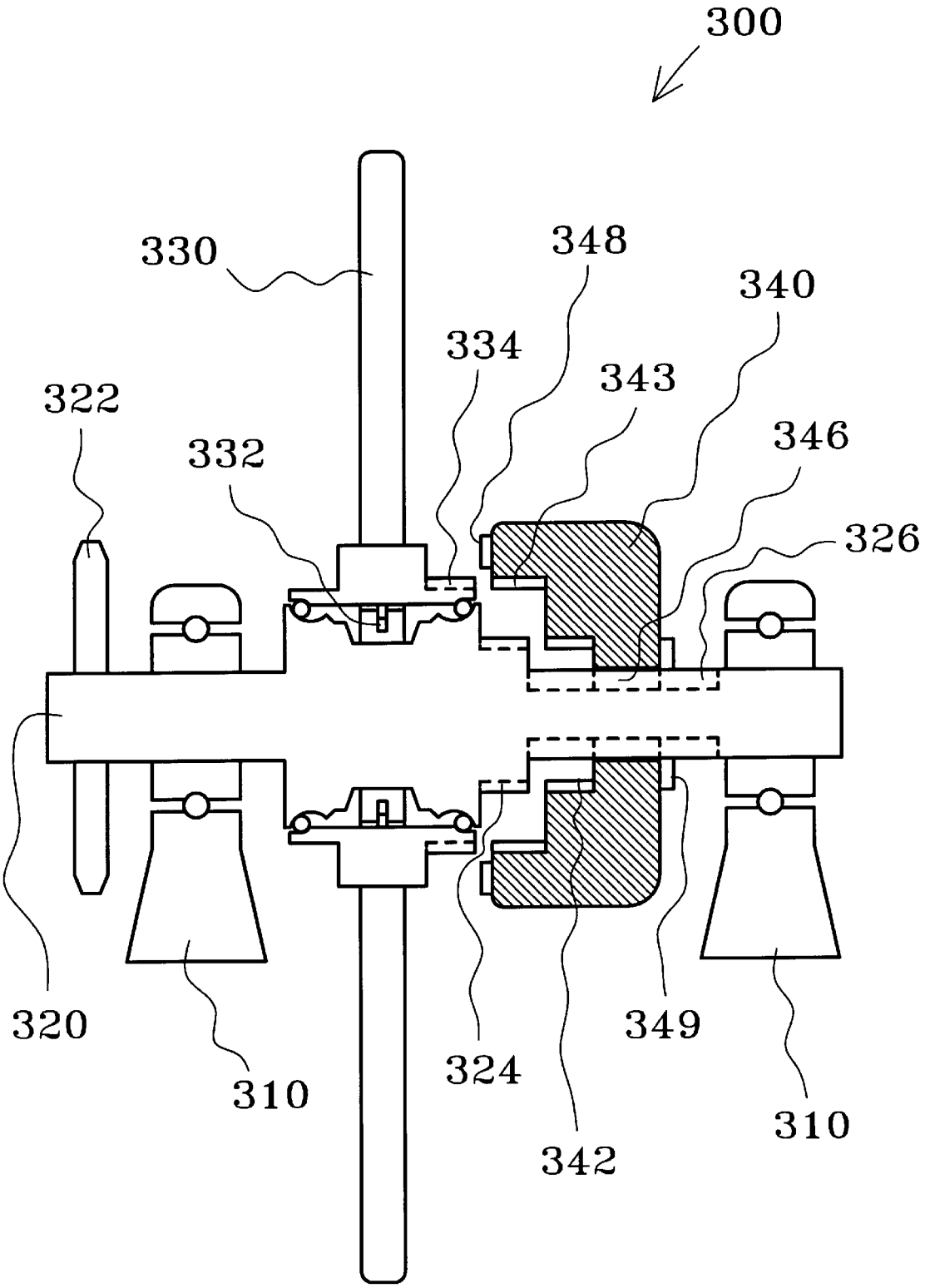
FIG. 5 is a partially sectioned end view of a first flywheel assembly constructed according to the principles of the present invention (with some cross-hatching omitted to facilitate illustration)

A first flywheel assembly constructed according to the principles of the present invention is designated as 300 in FIG. 5. The assembly 300 generally includes bearing assemblies 310 mounted on a frame; a shaft 320 rotatably mounted relative to the frame by means of the bearing assemblies 310; a flywheel 330 connected to the shaft 320 by means of a conventional one-way clutch 332; and a connector 340 mounted on the shaft 320 by means of a keyway 326 in the shaft 320 and a key 346 on the connector 340.

When the connector 340 occupies the position shown in FIG. 5, the shaft 320 is rotatable in a first direction together with the flywheel 330, and the shaft 320 is rotatable in a second, opposite direction relative to the flywheel 330. As a result, the shaft 320 is subject to flywheel inertia only when the shaft 320 is rotating as fast as the flywheel 330 and in the same direction. In other words, this configuration is comparable to a conventional bicycle or exercise bike which allows a user to "coast" or stop pedaling at any time.

The keyway arrangement between the connector 340 and the shaft 320 is such that the former is movable axially relative to the latter. As a result, the connector 340 may be moved toward the adjacent bearing assembly 310 until magnets 349 on the connector 340 engage the rotating portion of the bearing assembly 310 and thereby encourage the connector 340 to remain disengaged.

When the connector 340 is moved axially toward the flywheel 330, internal teeth 342 on the connector 340 interengage external teeth 324 on the shaft 320 and form a first spline at a first, relatively smaller radius, and internal teeth 343 on the connector 340 interengage external teeth 334 on the flywheel 340 and form a second spline at a second, relatively greater radius. In other words, the connector 340 is movable to a second position which rigidly links the flywheel 330 to the shaft 320. This second, alternative configuration is a direct drive assembly which does not provide a "coasting" option. Magnets 348 on the connector 340 engage the flywheel 330 and thereby encourage the connector 340 to remain engaged.

A sprocket 322 is rigidly secured to the shaft 320 and connected to a pedal assembly (or other force receiving member) by means of a chain. In the alternative, the force receiving member(s) may be connected directly to the shaft. In either case, the force receiving members will be constrained to rotate together with the flywheel 330 when the connector 340 is engaged therewith, and the force receiving members will be selectively rotatable together with the flywheel 330 when the connector occupies the position shown in FIG. 5.

One application for the assembly 300 is an exercise bike which is transformable between a "direct drive" mode and a "free-wheel" mode. The connector 340 is simply moved to the desired position to select the desired exercise mode. The movement of the connector 340 may be performed manually or by a powered actuator in response to an input signal. In either case, a safeguard is desirable to prevent switching between modes during exercise (with one possible exception discussed in the next paragraph). Such a safeguard may be a simple pin and/or detent arrangement for a manually adjustable embodiment, or a movement sensor in the case of machine driven adjustments.

Another application for the assembly 300 is a "direct drive" exercise bike which may be selectively transformed to a "free wheel" mode during operation. For example, if at any time the flywheel inertia poses a problem for the user, or if a sensor detects that a user's foot has left a pedal, then the connector is manually or automatically moved out of engagement with the flywheel 330.

Figure 6:
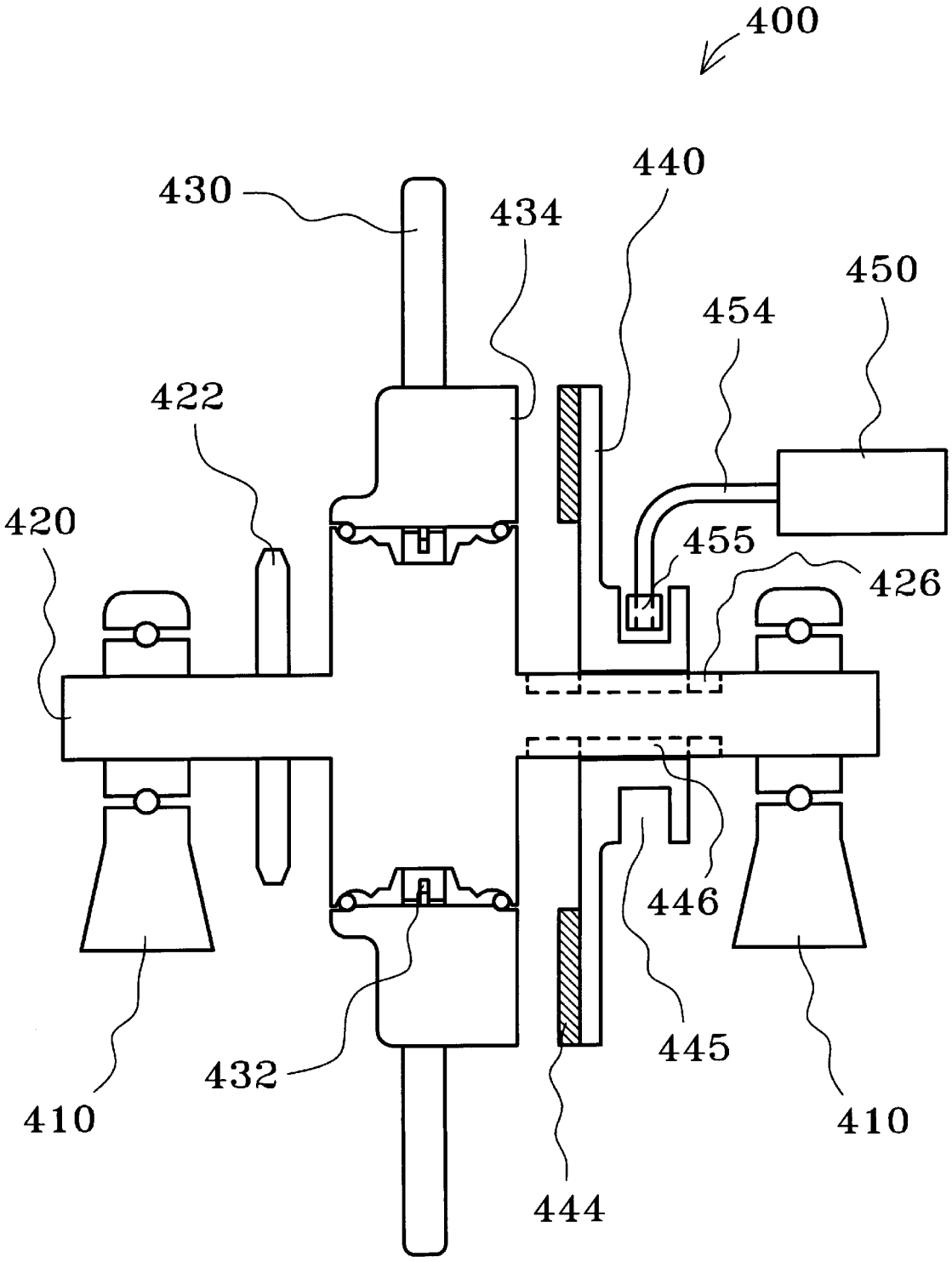
FIG. 6 is a partially sectioned end view of a second flywheel assembly constructed according to the principles of the present invention (with some cross-hatching omitted to facilitate illustration)

A second flywheel assembly constructed according to the principles of the present invention is designated as 400 in FIG. 6. The assembly 400 generally includes bearing assemblies 410 mounted on a frame; a shaft 420 rotatably mounted relative to the frame by means of the bearing assemblies 410; a flywheel 430 connected to the shaft 420 by means of a conventional one-way clutch 432; a connector 440 mounted on the shaft 420 by means of a keyway 426 in the shaft 420 and a key 446 on the connector 440; and an actuator 450 mounted on the frame and operatively connected to the connector 440.

When the connector 440 occupies the position shown in FIG. 6, the shaft 420 is rotatable in a first direction together with the flywheel 430, and the shaft 420 is rotatably in a second, opposite direction relative to the flywheel 430. As a result, the shaft 420 is subject to flywheel inertia only when the shaft 420 is rotating as fast as the flywheel 430 and in the same direction. A sprocket 422 is rigidly secured to the shaft 420 and operatively connected to at least one force receiving member by means of a chain.

The keyway arrangement between the connector 440 and the shaft 420 is such that the former is movable axially relative to the latter. When the connector 440 is moved toward the flywheel 430, friction pads 444 (or other members, such as magnets) on the connector 440 engage surfaces 434 on the flywheel 430. The connector 440 is keyed to the shaft 420 in such a manner that movement of the connector 440 to a second position (where the pads 444 engage the flywheel 430) rigidly links the flywheel 430 to the shaft 420. This second, alternative configuration is a direct drive assembly which does not provide a "coasting" option. However, the strength of the force applied by the pads 444 (or magnets) may be limited so that excessive torque cannot be transmitted from the flywheel 430 to the shaft 420. In this context, "excessive torque" means force that would tend to injure a person who suddenly stops pedaling while significant inertia is stored in the flywheel 430.

The connector 440 is moved relative to the shaft 420 by means of an actuator 450 having a telescoping portion 454 which has been bent ninety degrees and provided with a roller 455 at its distal end. The roller 455 is disposed inside a circumferential groove or race 445 on the connector 440 and is free to roll across a sidewall thereof during rotation of the shaft 420. The roller 455 pushes or pulls against a sidewall of the groove 445 to switch the assembly between a "free wheel" mode and a "direct drive" mode (and maintains pressure against the flywheel 430 when in the latter mode).

In the alternative, the actuator 450 may be eliminated and another magnet or magnets placed on an opposite end of the connector to selectively engage a radially extending stop secured to the shaft at the end of the keyway opposite the flywheel. The additional magnet(s) would retain the connector in the "free wheel" position until a user manually pulled the connector free and moved it axially so that the other magnet(s) 444 engaged the flywheel 430.

Another way to transmit only a limited amount of torque from the flywheel to the pedals is to introduce a slip clutch, as well as a one-way clutch, between the flywheel and the crank shaft. This particular alternative method of "limited torque transmission" is well suited for applications where the velocity of the foot members varies relative to the speed of flywheel rotation (e.g. elliptical motion machines). The one-way clutch engages positively and also allows the user to stop and coast, and the slip clutch creates enough drag between the foot members and the flywheel to drive the foot members through the ends of the stroke (where the flywheel might otherwise tend to run ahead of the foot members. In other words, when the absence of sufficient user-supplied force subjects the pedals to more rapid deceleration than the flywheel, the slip clutch will constrain the pedals to rotate together with the flywheel, but when the application of user-supplied force subjects the pedals to more rapid deceleration than the flywheel, the slip clutch will slip and allow the flywheel to "free wheel" relative to the pedals.

Braking Assemblies

Figure 7:
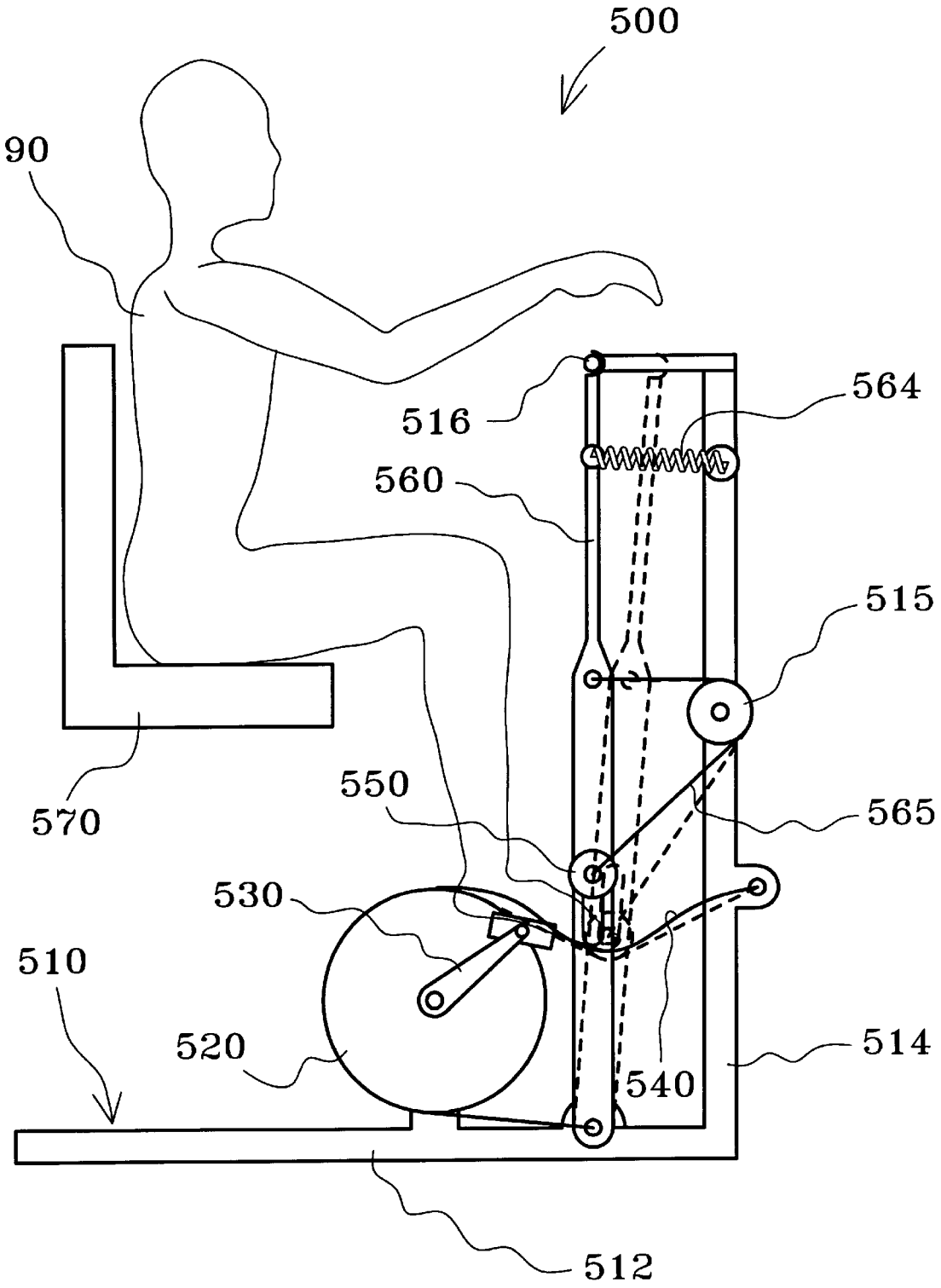
FIG. 7 is a side view of a third exercise apparatus constructed according to the principles of the present invention.

A first braking assembly constructed according to the principles of the present invention is designated as 500 in FIG. 7. The assembly 500 is described with reference to a cycling apparatus but may be used in connection on any machine with a manually driven inertia system. The cycling apparatus includes a frame 510 having a base 512 designed to rest upon a floor surface, and an upright or stanchion 514 extending upward from the base 512 proximate its forward end. The cycling apparatus is shown with reference to a person 90 sitting on a seat 570 which is mounted on the frame 510 (by means not shown).

A flywheel 520 is rotatably mounted on the base 512. Left and right pedal cranks 530 are also rotatably mounted on the base 512. On this embodiment 500, the pedal cranks 530 share a common rotational axis with the flywheel 520 and are keyed to the same shaft as the flywheel 520. However, the invention is not limited to this particular "direct drive"

arrangement. Among other things, the pedal assembly could be connected to a "stepped up" flywheel by means of a belt and pulleys, and/or the pedal assembly could be similar to those described with reference to FIGS. 5–6.

A lever 560 has a lower end which is pivotally mounted to the base 512, and an opposite, upper end which is sized and configured for grasping. A helical coil spring 564 is disposed in tension between the lever 560 and the stanchion 514, proximate the upper ends of each. The spring 564 pulls the lever 560 toward the stanchion 514 in the absence of user-supplied force against the lever 560. In FIG. 7, dashed lines are used to depict the lever 560 in a "rest" position, and solid lines are used to depict the lever 560 in an "operative" position, which requires a user-supplied pulling force against the upper end of the lever 560. A stop 516 is provided on the upper end of the stanchion 514 to limit rearward pivoting of the lever 560 relative to the frame 510.

A drag strap 540 has a first end which is secured to the lower end of the lever 560, and an opposite, second end which is secured to an intermediate portion of the stanchion 514. An intermediate portion of the drag strap 540 is disposed about a circumferential groove on the flywheel 520. The amount of slack in the drag strap 540 is exaggerated somewhat in FIG. 7 for purposes of illustration. Also, additional guides and/or alternative routing may be provided to ensure that the drag strap 540 remains align with the groove in the flywheel 520.

A bearing member 550 is slidably mounted within a slot on an intermediate portion of the lever 560. A rope or other flexible member 565 has a first end secured to the bearing member 550, an intermediate portion disposed about a roller 515 on the stanchion 514, and a second, opposite end secured to a relatively higher portion of the lever 560.

If the lever 560 is pulled to the operative position (shown in solid lines), the bearing member 550 moves upward along the lever 560, and the drag strap 540 is relatively slack, thereby leaving the flywheel 520 relatively free to rotate together with the pedals 530. If the lever 560 returns to the rest position (shown in dashed lines), the bearing member 550 drops downward along the lever 560 and pulls the drag strap 540 taut, thereby impeding rotation of the flywheel 520 and pedals 530.

Figure 8:
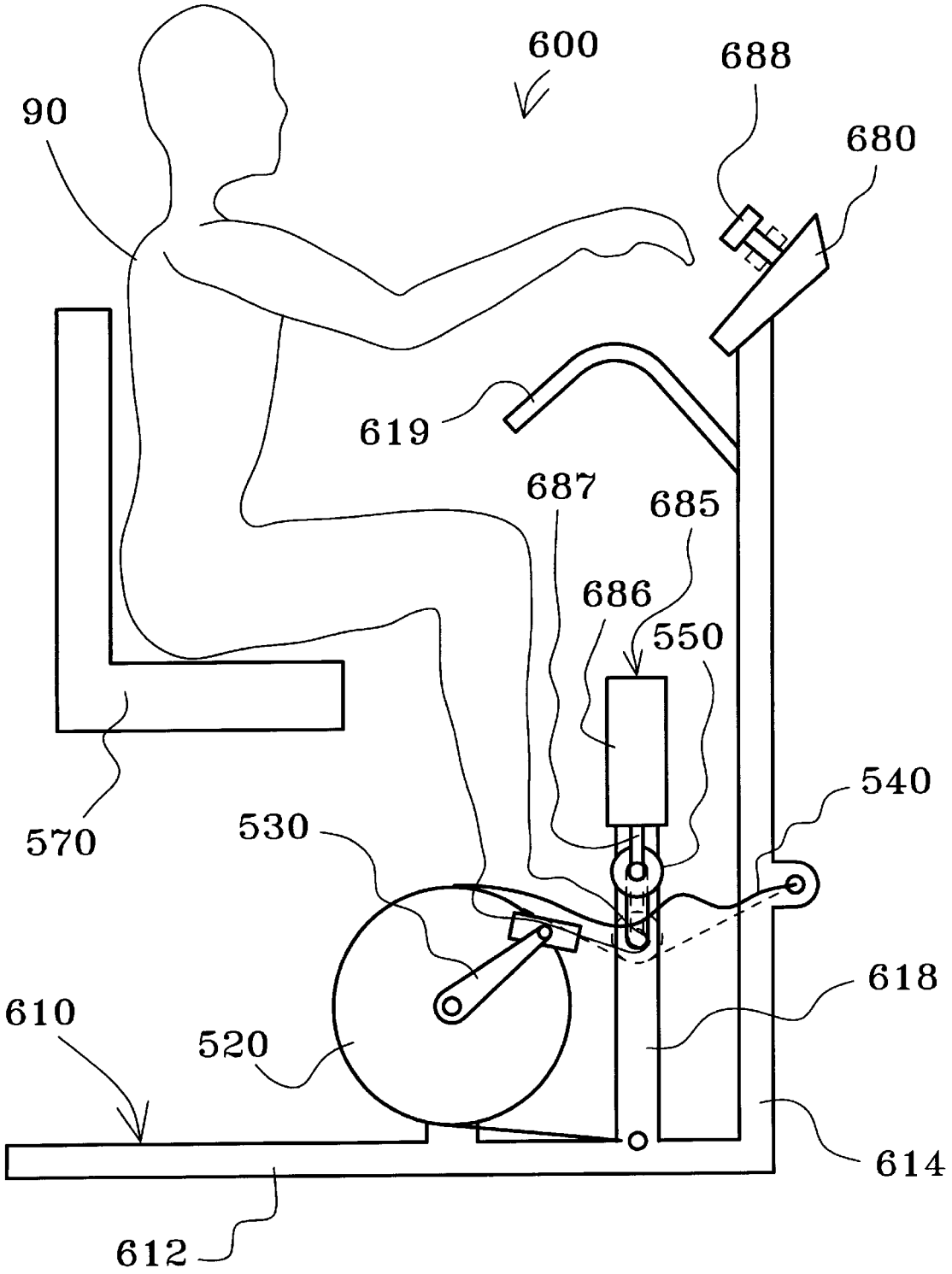
FIG. 8 is a side view of a fourth exercise apparatus constructed according to the principles of the present invention.

A second braking assembly constructed according to the principles of the present invention is designated as 600 in FIG. 8. The assembly 600 is described with reference to a cycling apparatus similar in many respects to that shown in FIG. 7. The cycling apparatus includes a frame 610 having a base 612 designed to rest upon a floor surface, a forward upright or stanchion 614 extending upward from the base 612, and an intermediate upright or stanchion 618 extending upward from the base 612. The cycling apparatus is shown with reference to a person 90 sitting on a seat 570 which is mounted on the frame 610 (by means not shown). Optional handlebars 619 are mounted on the stanchion 618 for use at the discretion of the user 90.

The same flywheel 520 and pedal cranks 530 are rotatably mounted on the base 612, and an identical drag strap 540 is routed about the flywheel 520 and interconnected between discrete portions of the frame 610. An actuator 685 has a first portion 686 rigidly secured to the stanchion 618, and a second portion 687 movably connected to the first portion 686. A like bearing member 550 is connected to the second portion 687 of the actuator 685 and is selectively movable along a slot in the intermediate stanchion 618.

If and when the actuator 685 is in a retracted configuration, the bearing member 550 is maintained out of engagement with the drag strap 540, and the slack drag strap 540 leaves the flywheel 520 relatively free to rotate together with the pedals 530. If and when the actuator 685 is in an extend configuration, the bearing member 550 engages the drag strap 540 and pulls it taut, thereby impeding rotation of the flywheel 520 and pedals 530. A controller and/or user interface 680 is mounted on the top of the forward stanchion 614. A button 688 is provided on the controller 680 and within reach of the person 90 sitting on the seat 570. The controller 680 is connected to the actuator 685 in such a manner that depression of the button 688 causes extension of the actuator 685.

Mechanisms other than (or in addition to) the drag strap 540 may be utilized to rapidly stop the flywheel 520. Some examples of such mechanisms include a disc brake pad/caliper arrangement, a stop pawl which swings into locking engagement with mating teeth on the flywheel, and drag rollers which are urged against a surface on the flywheel. Furthermore, the drag strap 540 may be arranged to provide adjustable resistance to exercise movement during a workout, as well as a quick acting brake in response to a user supplied signal. Moreover, the drag strap 540 may be arranged so that a user supplied force or range of movement determines the amount of resistance provided to rotation of the flywheel.

The present invention may also be described in terms of methods with reference to any and/or all of the improvements described above. For example, the present invention may be said to provide a method of exercising comprising the steps of: mounting a pedal assembly on a frame; rotatably mounting a flywheel on the frame; selectively arranging a connector relative to the flywheel and the pedal assembly to configure the pedal assembly for one of a plurality of modes of operation; mounting a braking assembly on the frame and in proximity to the flywheel; selectively arranging the braking assembly so that the flywheel is free to rotate relative to the frame but may be rapidly stopped at the user's discretion; mounting a seat on the frame; and selectively moving a first seat portion relative to a second seat portion to configure the seat for one of a plurality of available exercise postures relative to the pedal assembly.

The foregoing description and accompanying drawings set forth only some of the numerous possible embodiments of the present invention and will lead those skilled in the art to recognize additional embodiments, modifications, and/or applications. Accordingly, the scope of the present invention should be limited only to the extent of the claims which follow.

What is claimed is:

1. An exercise apparatus, comprising:

a frame designed to rest upon a floor surface;

a shaft rotatably mounted on said frame;

left and right foot supporting members movably mounted on said frame and connected to said shaft in such a manner that movement of said foot supporting members is linked to rotation of said shaft;

a flywheel rotatably mounted on said frame; and a connector mounted on said shaft and movable axially along said shaft between a first position, wherein said connector is capable of transmitting a torque between said shaft and said flywheel and a second position, wherein said connector is incapable of transmitting said torque between said shaft and said flywheel.

2. The exercise apparatus of claim 1, wherein said connector is rigidly interconnected between said shaft and said flywheel in said first position.

3. The exercise apparatus of claim 1, further comprising a one-way clutch interconnected between said shaft and said flywheel.

4. The exercise apparatus of claim 1, further comprising a means for encouraging said connector to remain in a current position.

5. An exercise apparatus, comprising:

a frame designed to rest upon a floor surface;

a shaft rotatably mounted on said frame;

left and right foot supporting members movably mounted on said frame and connected to said shaft in such a manner that movement of said foot supporting members is linked to rotation of said shaft;

a flywheel rotatably mounted on said frame; and a connector selectively interconnected between said shaft and said flywheel, wherein said connector is movable axially relative to said shaft between a first position, wherein said connector rotates together with said foot supporting members and said flywheel, and a second position, wherein said connector rotates relative to at least one of said foot supporting members and said flywheel.

6. The exercise apparatus of claim 5, wherein said flywheel and said shaft are coaxially arranged.

7. The exercise apparatus of claim 5, further comprising a one-way clutch interconnected between said shaft and said flywheel.

8. The exercise apparatus of claim 5, further comprising a means for encouraging said connector to remain in a current position.

9. An exercise apparatus, comprising:

a frame designed to rest upon a floor surface;

a shaft rotatably mounted on said frame;

left and right foot supporting members movably mounted on said frame and connected to said shaft in such a manner that movement of said foot supporting members is linked to rotation of said shaft;

a flywheel rotatably mounted on said frame; and a means for selectively imposing a direct drive relationship between said foot supporting members and said flywheel in a first state of operation, and for selectively imposing a free wheel relationship between said foot supporting members and said flywheel in a second state of operation.

10. The exercise apparatus of claim 9, wherein said means includes a connector which is axially movable along said shaft between a first position, wherein said shaft is locked to said flywheel, and a second position, wherein said shaft is free to rotate in at least one direction relative to said flywheel.

11. An exercise apparatus, comprising:

a frame designed to rest upon a floor surface;

a shaft rotatably mounted on said frame;

left and right foot supporting members movably mounted on said frame and connected to said shaft in such a manner that movement of said foot supporting members is linked to rotation of said shaft;

a flywheel rotatably mounted on said frame;

a one-way clutch interconnected between said flywheel and said shaft to transmit torque in only one direction from said shaft to said flywheel; and a discrete connector constrained to rotate together with one of said flywheel and said shaft and selectively movable into and out of contact with the other of said flywheel and said shaft, wherein when in contact with both said flywheel and said shaft, said connector transmits torque in said one direction from said flywheel to said shaft.

12. The exercise apparatus of claim 11, wherein said connector is keyed to an axially extending groove in said shaft.

13. The exercise apparatus of claim 12, wherein when in contact with both said flywheel and said shaft, said connector is splined both to said flywheel and to a portion of said shaft apart from said groove.

14. The exercise apparatus of claim 12, further comprising a magnet disposed between said connector and said frame to bias said connector to remain out of contact with said flywheel.

15. The exercise apparatus of claim 12, further comprising a magnet disposed between said connector and said flywheel to bias said connector to remain in contact with said flywheel.

16. The exercise apparatus of claim 12, wherein an actuator maintains a desired spatial relationship between said connector and said flywheel.

* * * * *